US010784654B2

(12) United States Patent
Kawai

(10) Patent No.: US 10,784,654 B2
(45) Date of Patent: Sep. 22, 2020

(54) SPARK PLUG

(71) Applicant: NGK SPARK PLUG CO., LTD., Nagoya-shi, Aichi (JP)

(72) Inventor: Tomoki Kawai, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/427,467

(22) Filed: May 31, 2019

(65) Prior Publication Data

US 2019/0386466 A1 Dec. 19, 2019

(30) Foreign Application Priority Data

Jun. 13, 2018 (JP) ..... 2018-112958

(51) Int. Cl.

| | |
|---|---|
| ***H01T 13/39*** | (2006.01) |
| ***H01T 13/22*** | (2006.01) |
| ***H01T 21/02*** | (2006.01) |
| ***H01T 13/52*** | (2006.01) |

(52) U.S. Cl.

CPC ..... *H01T 13/22* (2013.01); *H01T 13/39* (2013.01); *H01T 13/52* (2013.01); *H01T 21/02* (2013.01)

(58) Field of Classification Search

CPC ..... H01T 13/39; H01T 13/52

See application file for complete search history.

(56) References Cited

U.S. PATENT DOCUMENTS

2012/0015578 A1* 1/2012 Nakayama ..... H01T 13/38 445/7

FOREIGN PATENT DOCUMENTS

WO 2010/113404 A1 10/2010

* cited by examiner

*Primary Examiner* — Joseph L Williams
*Assistant Examiner* — Jacob R Stern
(74) *Attorney, Agent, or Firm* — Kusner & Jaffe

(57) ABSTRACT

Spark plug has first and second electrodes. First electrode has tip principally made of noble metal and base material principally made of Ni. The tip is joined to the base material through fusion portion. Second electrode faces discharge surface of the tip. The fusion portion has overlap portion where first interface between the tip and the fusion portion and second interface between the base material and the fusion portion overlap in first direction perpendicular to the discharge surface. When viewing cross section which passes through a center of gravity of the overlap portion projected onto virtual surface parallel to the discharge surface and is perpendicular to the discharge surface, noble metal content is greater than 50 mass % at one end portion of the overlap portion in second direction extending along the discharge surface, and Ni content is greater than 50 mass % at the other end portion of the overlap portion.

4 Claims, 5 Drawing Sheets

SPARK PLUG

BACKGROUND OF THE INVENTION

The present invention relates to a spark plug, and more particularly to a spark plug formed by joining a tip principally made of noble metal to a base material principally made of Ni (nickel) together.

As such spark plug, for instance, International Publication WO2010113404 discloses a spark plug formed by joining a tip principally made of noble metal to a base material principally made of Ni (nickel) together through a fusion portion.

SUMMARY OF THE INVENTION

In the International Publication WO2010113404, however, since there is a difference in coefficient of linear expansion between the base material and the tip, a thermal stress occurs at the fusion portion due to temperature change of an engine in which the spark plug is mounted, and there is a possibility that a crack will appear at the fusion portion due to the thermal stress and develop around the fusion portion, then the tip will come off the base material. A technique of solving this problem, i.e. a technique of suppressing the coming-off of the tip from the base material even if the crack appearing at the fusion portion due to the thermal stress develops, has therefore been required.

The present invention was made to meet the above requirement. An object of the present invention is therefore to provide a spark plug that is capable of suppressing the coming-off of the tip from the base material.

To achieve the above object, according to one aspect of the present invention, a spark plug comprises: a first electrode having a tip principally made of noble metal and a base material principally made of Ni, the tip being joined to the base material through a fusion portion; and a second electrode provided so as to face a discharge surface of the tip. And, the fusion portion has an overlap portion where a first interface between the tip and the fusion portion and a second interface between the base material and the fusion portion overlap each other in a first direction that is perpendicular to the discharge surface, and when viewing a cross section which passes through a center of gravity of the overlap portion projected onto a virtual surface parallel to the discharge surface and which is perpendicular to the discharge surface, a noble metal content is greater than 50 mass % at one end portion of the overlap portion in a second direction that extends along the discharge surface, and a Ni content is greater than 50 mass % at the other end portion of the overlap portion in the second direction.

According to the above spark plug, on the cross section perpendicular to the discharge surface, the noble metal content is greater than 50 mass % at the one end portion of the overlap portion in the second direction extending along the discharge surface of the tip, and the Ni content is greater than 50 mass % at the other end portion of the overlap portion in the second direction. Therefore, at the one end portion of the overlap portion, a thermal stress occurring at the second interface between the base material and the fusion portion is greater than a thermal stress occurring at the first interface between the tip and the fusion portion. On the other hand, at the other end portion of the overlap portion, a thermal stress occurring at the first interface is greater than a thermal stress occurring at the second interface. Consequently, at the one end portion side, a crack tends to appear at the second interface, whereas at the other end portion side, a crack tends to appear at the first interface. The crack tends to develop along the interface. However, even if the cracks develop, thanks to the above structure, it is possible to reduce a tendency for the cracks developing along the first and second interfaces to join together. Hence, coming-off of the tip from the base material can be suppressed.

According to the above spark plug, the overlap portion has a shape on the cross section such that a distance between the first interface and the second interface along the first direction is gradually longer toward the second direction, and in the overlap portion on the cross section, a middle portion at which the noble metal content is 50 mass % and also the Ni content is 50 mass % exists on the second direction side with respect to a center position in the second direction of the overlap portion.

Therefore, a position where the cracks developing along the first interface and the second interface respectively overlap each other in the first direction tends to shift to or get closer to the second direction side with respect to the center position. Thus, even if the cracks develop along the first direction at this position, since a distance between the first interface and the second interface at this position is relatively long, in addition of the above effect, the coming-off of the tip can be further suppressed.

According to the above spark plug, in the overlap portion on the cross section, a shortest portion at which a distance between the first interface and the second interface along the first direction is shortest exists at a portion except the one end portion and the other end portion, and a middle portion at which the noble metal content is 50 mass % and also the Ni content is 50 mass % exists at a portion except the shortest portion in the overlap portion on the cross section.

Therefore, a position where the cracks developing along the first interface and the second interface respectively overlap each other in the first direction tends to be located at a portion except the shortest portion. Thus, even if the cracks develop along the first direction at this position, since a distance between the first interface and the second interface at this position is relatively long, in addition of the above effect, the coming-off of the tip can be further suppressed.

According to the above spark plug, at least one relationship described above is established on the cross section on which a length of the overlap portion in the second direction becomes longest. Therefore, in addition of the above effect, lengths of the first interface and the second interface on which the cracks tend to develop can be longest.

The other objects and features of this invention will become understood from the following description with reference to the accompanying drawings.

DETAILED DESCRIPTION OF THE INVENTION

Figure 1:
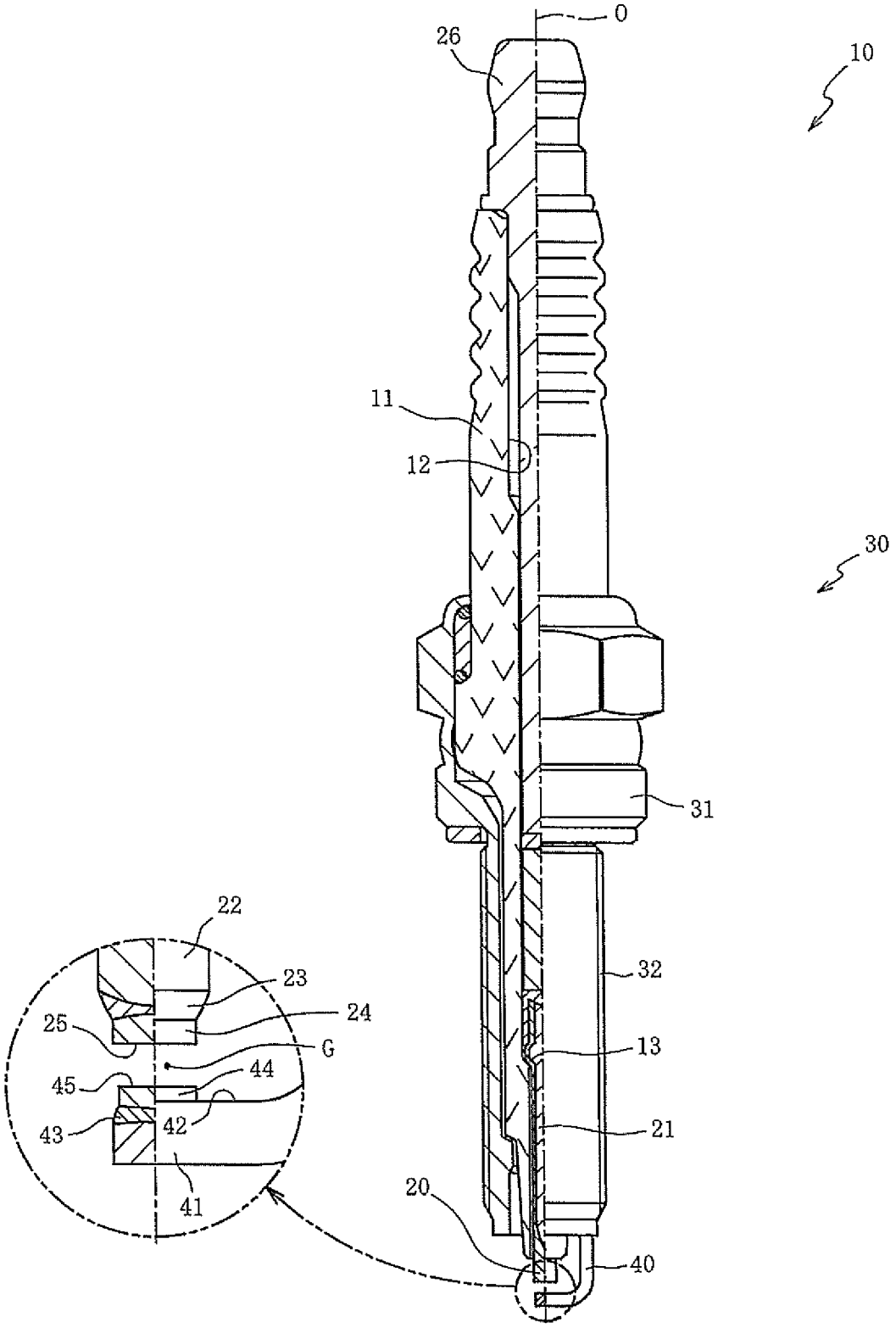
FIG. 1 is a sectional view of a spark plug according to an embodiment of the present invention.

An embodiment of the present invention will be explained below with reference to the drawings. FIG. 1 is a sectional view of a spark plug 10 according to an embodiment of the present invention with axis O being a boundary. In FIG. 1, a lower side of the drawing is called a front end side (or a top end side) of the spark plug 10, and an upper side of the drawing is called a rear end side of the spark plug 10. As shown in FIG. 1, the spark plug 10 has a center electrode 20 and a ground electrode 40.

An insulator 11 is a substantially tubular member provided with an axial hole 12 that extends along the axis O. The insulator 11 is made of ceramic such as alumina which is superior in mechanical characteristics and insulation performance under high temperature. The insulator 11 has, at a front side on an inner peripheral surface of the axial hole 12 thereof, a rear-end-facing surface 13 that is an annular surface facing the rear end side. A diameter of the rear-end-facing surface 13 is reduced toward the front end side.

The center electrode 20 is a rod-shaped member engaged with and supported on the rear-end-facing surface 13. A top end of the center electrode 20 protrudes from a top end of the insulator 11 toward the front end side. The center electrode 20 is formed by covering a core 21 principally made of copper with a closed-bottomed tubular base material 22. The base material 22 has a chemical composition containing 50 wt % or more of Ni. Here, the core 21 could be omitted. A tip 24 is joined to a top end of the base material 22 through a fusion portion (or a melting portion) 23. The tip 24 has a chemical composition containing 50 wt % or more of at least one noble metal selected from Pt, Rh, Ir, Ru etc. A discharge surface 25 of the tip 24 faces the ground electrode 40. The center electrode 20 is electrically connected to a metal terminal 26 in the axial hole 12.

The metal terminal 26 is a rod-shaped member to which a high-tension cable (not shown) is connected. The metal terminal 26 is made of metal material (e.g. low-carbon steel) having conductivity. The metal terminal 26 is fixed at a rear end side of the insulator 11 with a top end of the metal terminal 26 inserted into the axial hole 12 of the insulator 11.

A metal shell 30 is secured to an outer periphery at the top end side of the insulator 11 by caulking. The metal shell 30 is a substantially tubular member made of metal material (e.g. low-carbon steel) having conductivity. The metal shell 30 has a brim-shaped seat portion 31 extending or bulging in a radially outward direction and a thread portion 32 formed on an outer peripheral surface at a top end side of the metal shell 30 with respect to the seat portion 31. By screwing the thread portion 32 into a screw hole (not shown) of an engine (a cylinder head), the metal shell 30 is fixed to the engine (the cylinder head). The ground electrode 40 is connected to a top end portion of the metal shell 30.

The ground electrode 40 is a rod-shaped member made of metal material having conductivity. The ground electrode 40 has a base material 41 connected to the metal shell 30 and a tip 44 located on an inner surface 42, which faces the center electrode 20, of the base material 41 and joined to the base material 41 through a fusion portion (or a melting portion) 43. The base material 41 has a chemical composition containing 50 wt % or more of Ni. The tip 44 has a chemical composition containing 50 wt % or more of at least one noble metal selected from Pt, Rh, Ir, Ru etc. A discharge surface 45 of the tip 44 faces the center electrode 20. A spark gap G is formed between the discharge surface 45 of the tip 44 and the center electrode 20.

Figure 2A:
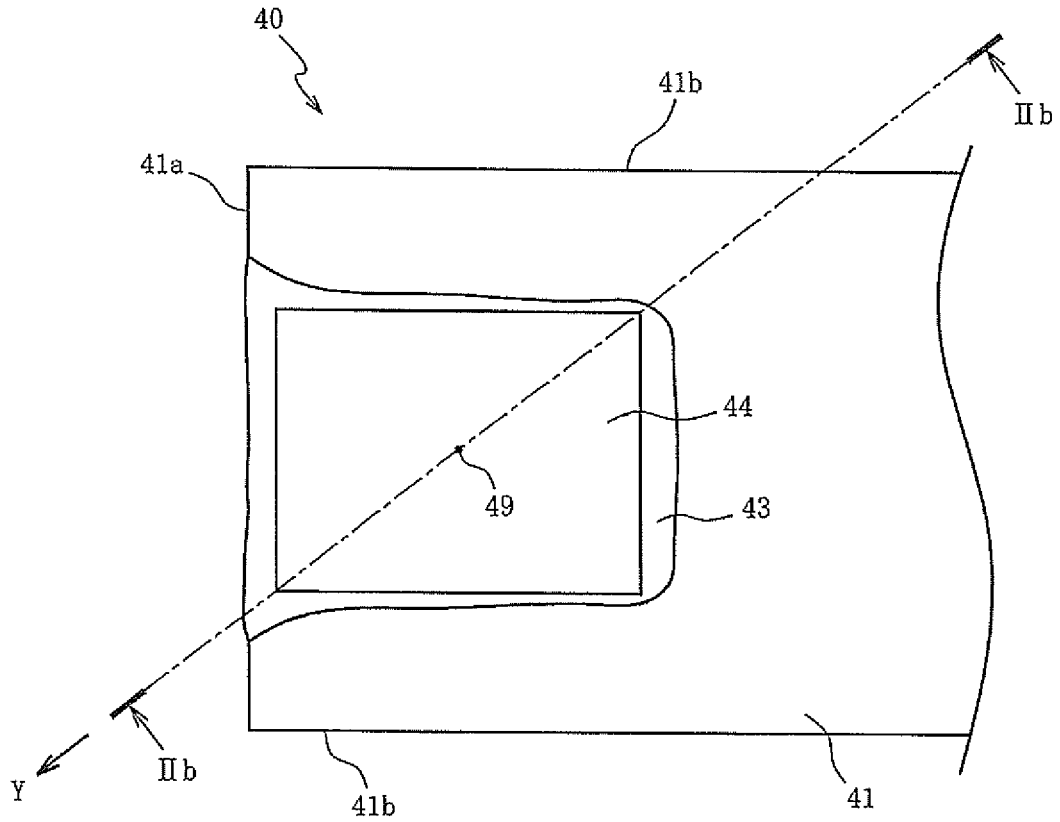
FIG. 2A is a plan view of a ground electrode.
Figure 2B:
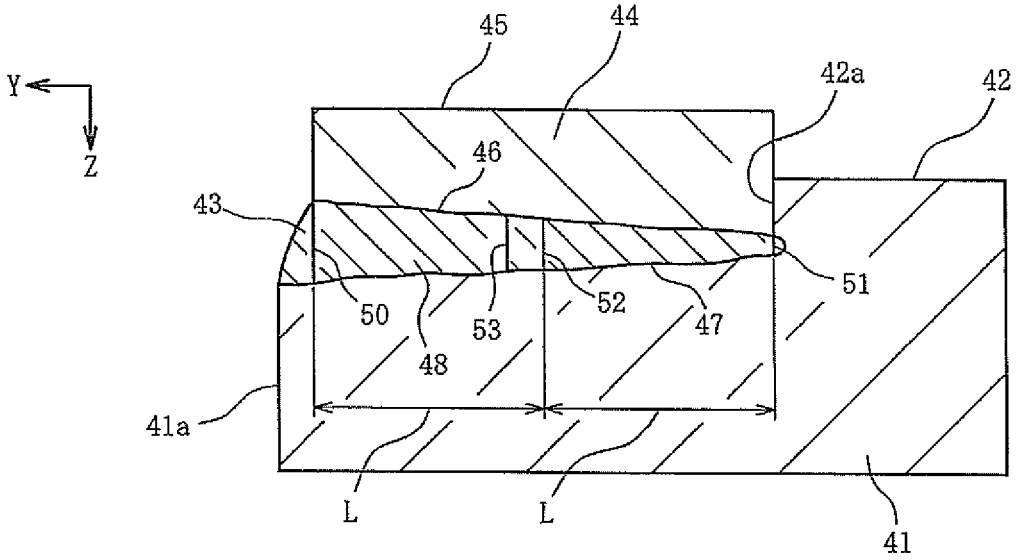
FIG. 2B is a sectional view of the ground electrode, taken along a line IIb-IIb of FIG. 2A.

FIG. 2A is a plan view of the ground electrode 40 (a first electrode), viewed from a direction of the axis O. FIG. 2B is a sectional view of the ground electrode 40, taken along a line IIb-IIb of FIG. 2A. An arrow Z indicates a first direction that is perpendicular to the discharge surface 45 of the tip 44. If the ground electrode 40 is defined as the first electrode, the center electrode 20 is a second electrode. In the present embodiment, the base material 41 has a rod-shape having a substantially rectangular cross section, and the tip 44 has a rectangular parallelepiped. A part of the tip 44 is placed in a recessed groove that is formed by being set back into the inner surface 42 located at a top end portion of the base material 41 along a side surface 41*b* of the base material 41. A position of the tip 44 is limited by a wall surface 42*a* of the groove. The tip 44 is joined to the base material 41 through the fusion portion 43. The fusion portion 43 is a portion where the tip 44 and the base material 41 are fused together.

The fusion portion 43 has an overlap portion 48 where a first interface (or a first boundary) 46 between the tip 44 and the fusion portion 43 and a second interface (or a second boundary) 47 between the base material 41 and the fusion portion 43 overlap each other in the first direction (the arrow Z direction). FIG. 2B is also a sectional view of the ground electrode 40, cut by a cutting-plane line (the line IIb-IIb) passing through a center of gravity 49 of a projected planform of the overlap portion 48 onto a virtual surface (a surface parallel to the drawing of FIG. 2A) parallel to the discharge surface 45 of the tip 44. An arrow Y indicates a second direction that is a direction parallel to the discharge surface 45 and extends on the cutting-plane line (the line IIb-IIb). Although the cutting-plane line passing through the center of gravity 49 can be drawn innumerably, in the present embodiment, the cutting-plane line is drawn on a diagonal line of the discharge surface 45 of the tip 44 such that a length of the overlap portion 48 in the second direction becomes a maximum (becomes longest). Analysis on its cross section is then carried out.

Figure 3A:
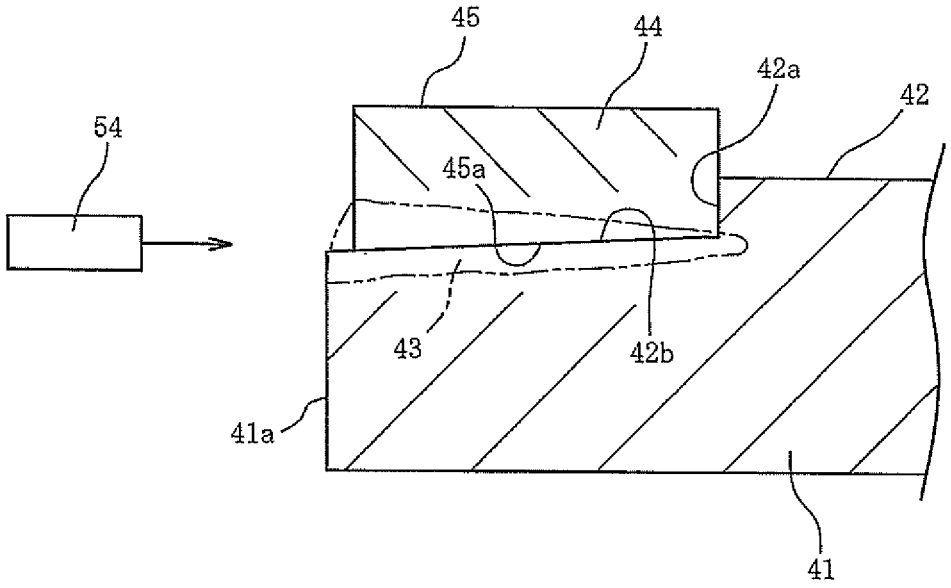
FIG. 3A is a schematic view when joining a tip to a base material.
Figure 3B:
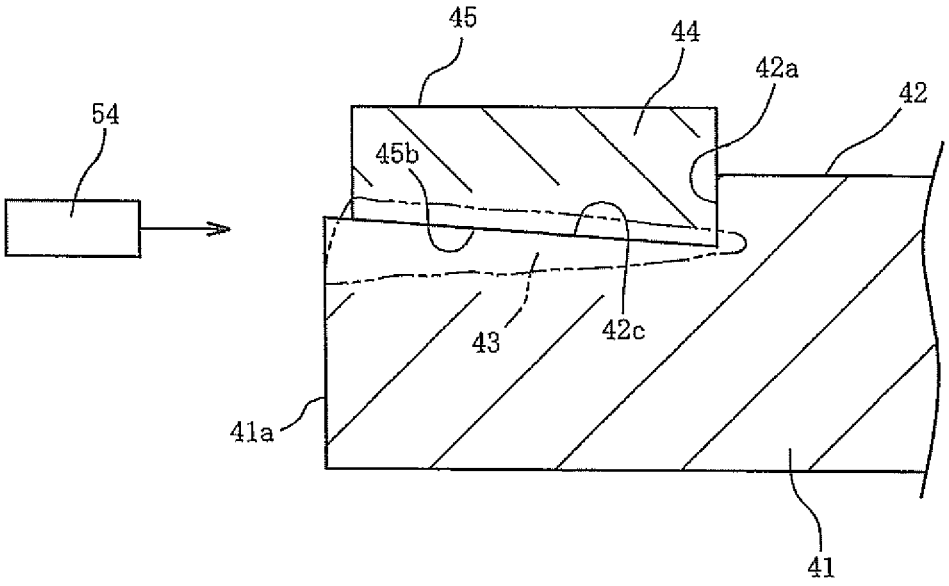
FIG. 3B is a schematic view when joining the tip to the base material according to a modified example.

An example of a method of producing the ground electrode 40 will be explained with reference to FIG. 3A. FIG. 3A is a schematic view when joining the tip 44 to the base material 41, and shows a state before the fusion portion 43 (indicated by a two-dot chain line) is formed. FIG. 3A is a cross section cut by a cutting-plane line that is perpendicular to a top end surface 41*a* of the base material 41 and parallel to the side surface 41*b* of the base material 41. FIG. 3B is similar to the above-explained FIG. 3A, namely that FIG. 3B is a cross section cut by the above cutting-plane line and shows a state before the fusion portion 43 (indicated by a two-dot chain line) is formed.

A groove bottom 42*b*, which is a bottom of the groove on the inner surface 42 of the base material 41, inclines or slopes from the wall surface 42*a* toward the top end surface 41*a* such that a depth of the groove is deeper from the wall surface 42*a* toward the top end surface 41*a*. A bottom surface 45*a* of the tip 44 also inclines or slopes such that a portion, located close to the wall surface 42*a* of the base material 41, of the tip 44 is thinner than a portion, located close to the top end surface 41*a* of the base material 41, of the tip 44.

After placing the tip 44 on the groove of the base material 41, high-energy beam such as laser beam and electron beam is radiated from a beam-machining head 54 provided so as to face to the top end surface 41*a* of the base material 41. By moving the beam-machining head 54 along the groove bottom 42*b* while radiating the beam, the fusion portion 43 is formed, then the tip 44 is joined to the base material 41. Since the beam is radiated to the top end surface 41*a* of the base material 41, a melting amount at the top end surface 41*a* side is large as compared with that at the wall surface 42*a* side. Further, as mentioned above, since the bottom surface 45*a* of the tip 44 and the groove bottom 42*b* of the inner surface 42 of the base material 41 slope, at the top end surface 41*a* side in the fusion portion 43, a melting amount of the tip 44 is larger than a melting amount of the base material 41, whereas at the wall surface 42*a* side in the fusion portion 43, a melting amount of the base material 41 is larger than a melting amount of the tip 44.

Returning to FIG. 2B, this will be explained in detail. In the present embodiment, at one side end portion 50 (one end portion) of the overlap portion 48 in the second direction (the arrow Y direction) along the discharge surface 45 of the tip 44, since the melting amount of the tip 44 is larger than the melting amount of the base material 41, a noble metal content is greater than 50 mass %. On the other hand, at the other side end portion 51 (the other end portion) of the overlap portion 48 in the second direction, since the melting amount of the base material 41 is larger than the melting amount of the tip 44, a Ni content is greater than 50 mass %. Here, each of the end portions 50 and 51 is a line segment whose both ends are defined by the first and second interfaces 46 and 47. Each of the end portions 50 and 51 is perpendicular to the discharge surface 45.

As mentioned above, since the differences in the noble metal content and the Ni content exist between the end portions 50 and 51, at the end portion 50, a thermal stress occurring at the second interface 47 is greater than a thermal stress occurring at the first interface 46. On the other hand, at the end portion 51, a thermal stress occurring at the first interface 46 is greater than a thermal stress occurring at the second interface 47. Consequently, at the end portion 50 side, a crack tends to appear at the second interface 47, whereas at the end portion 51 side, a crack tends to appear at the first interface 46. Further, the crack appearing at the first interface 46 tends to develop along the first interface 46, and the crack appearing at the second interface 47 tends to develop along the second interface 47. However, even if the cracks develop in this way, thanks to the above structure, it is possible to reduce a tendency for the cracks developing along the first and second interfaces 46 and 47 to join together. Therefore, as compared with a case where cracks appearing at both ends of one interface develop toward the middle of the interface along the interface, coming-off of the tip 44 from the base material 41 due to rupture of the fusion portion 43 can be suppressed.

Here, quantitative analysis to measure the noble metal content and the Ni content at the end portions 50 and 51 of the overlap portion 48 can be carried out by WDS (Wavelength Dispersive Spectrometry) analysis using EPMA (Electron Probe Micro Analyzer). A width of each of the end portions 50 and 51 (a thickness of each line segment) in the second direction is a width required for the quantitative analysis (in the present embodiment, it is at least 20 μm). Each of the noble metal content and the Ni content at the end portions 50 and 51 can be measured by taking an average of measurement values of a plurality of measurement points which are set at the same regular intervals on both line segments of the end portions 50 and 51. Instead of this, a measurement value of a midpoint of each line segment of the end portions 50 and 51 could be a central value.

As mentioned above, in the fusion portion 43, since the melting amount at the top end surface 41*a* side is large as compared with that at the wall surface 42*a* side, the overlap portion 48 is shaped so that a distance between the first interface 46 and the second interface 47 along the first direction (the arrow Z direction) is gradually longer toward the second direction (the arrow Y direction). In the overlap portion 48, a middle portion 53 at which the noble metal content is 50 mass % and also the Ni content is 50 mass % exists on the second direction side (the arrow Y direction side) with respect to a center position 52 in the second direction of the overlap portion 48. The center position 52 is a position including a middle point that is located at the same L distance from the end portion 50 and from the end portion 51.

Therefore, as compared with a section of the first interface 46 from the end portion 50 up to the middle portion 53, at a section of the first interface 46 from the end portion 51 up to the middle portion 53, the crack appearing at the end portion 51 side tends to develop along the first interface 46. On the other hand, as compared with a section of the second interface 47 from the end portion 51 up to the middle portion 53, at a section of the second interface 47 from the end portion 50 up to the middle portion 53, the crack appearing at the end portion 50 side tends to develop along the second interface 47. Consequently, a position where the cracks developing along the first interface 46 and the second interface 47 respectively overlap each other in the first direction (the arrow Z direction) tends to shift to or get closer to the second direction (the arrow Y direction) side with respect to the center position 52. Therefore, even if the cracks develop along the first direction (the arrow Z direction) at this position in the fusion portion 43, since a distance between the first interface 46 and the second interface 47 at this position is longer than that at the end portion 51 side with respect to the center position 52 of the overlap portion 48, rupture of the fusion portion 43 is suppressed, then the coming-off of the tip 44 from the base material 41 can be further suppressed.

It is noted that a relationship showing that the noble metal content is greater than 50 mass % at the one side end portion 50 and the Ni content is greater than 50 mass % at the other side end portion 51 is established on the cross section on which the length of the overlap portion 48 in the second direction (the arrow Y direction) becomes a maximum (becomes longest). Since lengths of the first interface 46 and the second interface 47 on which the cracks tend to develop are longest at this cross section position, the coming-off of the tip 44 from the base material 41 can be further suppressed.

A modified example of the ground electrode 40 will be explained with reference to FIG. 3B. FIG. 3B is a schematic view when joining the tip 44 to the base material 41. Unlike the case of FIG. 3A, a groove bottom 42*c*, which is a bottom of the groove on the inner surface 42 of the base material 41, inclines or slopes from the wall surface 42*a* toward the top end surface 41*a* such that a depth of the groove is shallower from the wall surface 42*a* toward the top end surface 41*a*. A bottom surface 45*b* of the tip 44 also inclines or slopes such that a portion, located close to the wall surface 42*a* of the base material 41, of the tip 44 is thicker than a portion, located close to the top end surface 41*a* of the base material 41, of the tip 44.

After placing the tip 44 on the groove of the base material 41, by radiating high-energy beam from the beam-machining head 54 provided so as to face to the top end surface 41*a* of the base material 41, the fusion portion 43 is formed, then the tip 44 is joined to the base material 41. Because of the slopes of the bottom surface 45*b* of the tip 44 and the groove bottom 42*c* of the inner surface 42 of the base material 41, at the top end surface 41*a* side in the fusion portion 43, a melting amount of the base material 41 is larger than a melting amount of the tip 44, whereas at the wall surface 42*a* side in the fusion portion 43, a melting amount of the tip 44 is larger than a melting amount of the base material 41.

Returning to FIG. 2B, this will be explained in detail. In this example, at one side end portion 50 (one end portion) of the overlap portion 48 in the second direction (the arrow Y direction) along the discharge surface 45 of the tip 44, since the melting amount of the base material 41 is larger than the melting amount of the tip 44, a Ni content is greater than 50 mass %. On the other hand, at the other side end portion 51 (the other end portion) of the overlap portion 48 in the second direction, since the melting amount of the tip 44 is larger than the melting amount of the base material 41, a noble metal content is greater than 50 mass %.

Therefore, at the end portion 50, a thermal stress occurring at the first interface 46 is greater than a thermal stress occurring at the second interface 47. On the other hand, at the end portion 51, a thermal stress occurring at the second interface 47 is greater than a thermal stress occurring at the first interface 46. Consequently, at the end portion 50 side, a crack tends to appear at the first interface 46, whereas at the end portion 51 side, a crack tends to appear at the second interface 47. Further, the crack appearing at the first interface 46 tends to develop along the first interface 46, and the crack appearing at the second interface 47 tends to develop along the second interface 47. However, even if the cracks develop in this way, thanks to the above structure, it is possible to reduce a tendency for the cracks developing along the first and second interfaces 46 and 47 to join together. Therefore, as compared with a case where cracks appearing at both ends of one interface develop toward the middle of the interface along the interface, coming-off of the tip 44 from the base material 41 due to rupture of the fusion portion 43 can be suppressed.

Figure 4A:
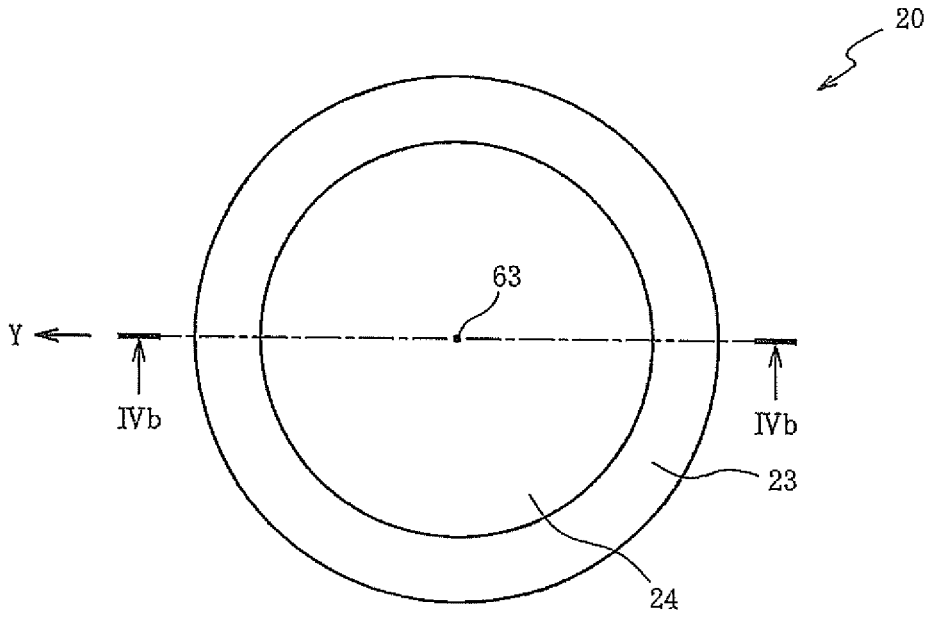
FIG. 4A is a bottom view of a center electrode.
Figure 4B:
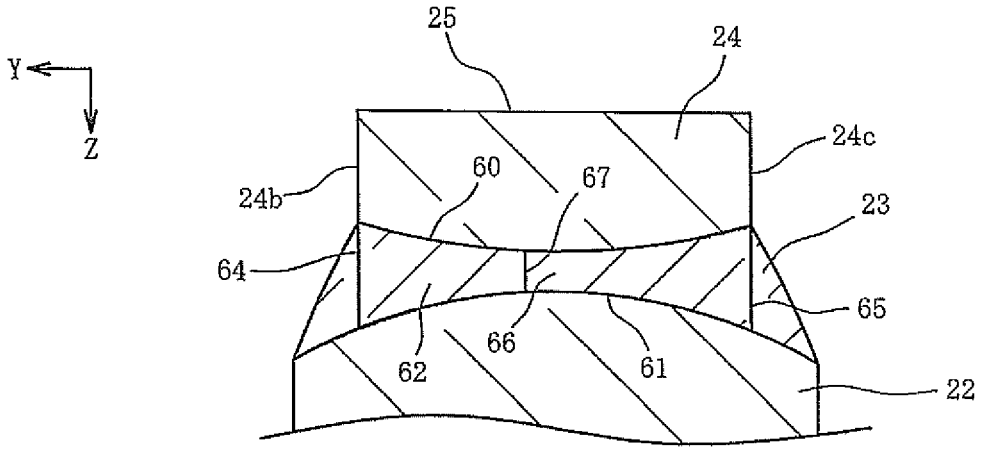
FIG. 4B is a sectional view of the center electrode, taken along a line IVb-IVb of FIG. 4A.

Next, the center electrode 20 will be explained. FIG. 4A is a bottom view of the center electrode 20 (a first electrode), viewed from a direction of the axis O. FIG. 4B is a sectional view of the center electrode 20, taken along a line IVb-IVb of FIG. 4A. An arrow Z indicates a first direction that is perpendicular to the discharge surface 25 of the tip 24. If the center electrode 20 is defined as the first electrode, the ground electrode 40 is a second electrode. In the present embodiment, the base material 22 has, as an outside shape, a cylindrical-columned shape extending along the axis O, and the tip 24 has a disc shape. The tip 24 is placed at a top end in the axis direction of the base material 22, and joined to the base material 22 through the fusion portion 23. The fusion portion 23 is a portion where the tip 24 and the base material 22 are fused together.

The fusion portion 23 has an overlap portion 62 where a first interface (or a first boundary) 60 between the tip 24 and the fusion portion 23 and a second interface (or a second boundary) 61 between the base material 22 and the fusion portion 23 overlap each other in the first direction (which is identical with the axis O direction, the arrow Z direction). FIG. 4B is also a sectional view of the center electrode 20, cut by a cutting-plane line (the line IVb-IVb) passing through a center of gravity 63 of a projected planform of the overlap portion 62 onto a virtual surface (a surface parallel to the drawing of FIG. 4A) parallel to the discharge surface 25 of the tip 24. A position of the center of gravity 63 is substantially identical with a position of the axis O. An arrow Y indicates a second direction that is a direction parallel to the discharge surface 25 and extends on the cutting-plane line (the line IVb-IVb).

Figure 5A:
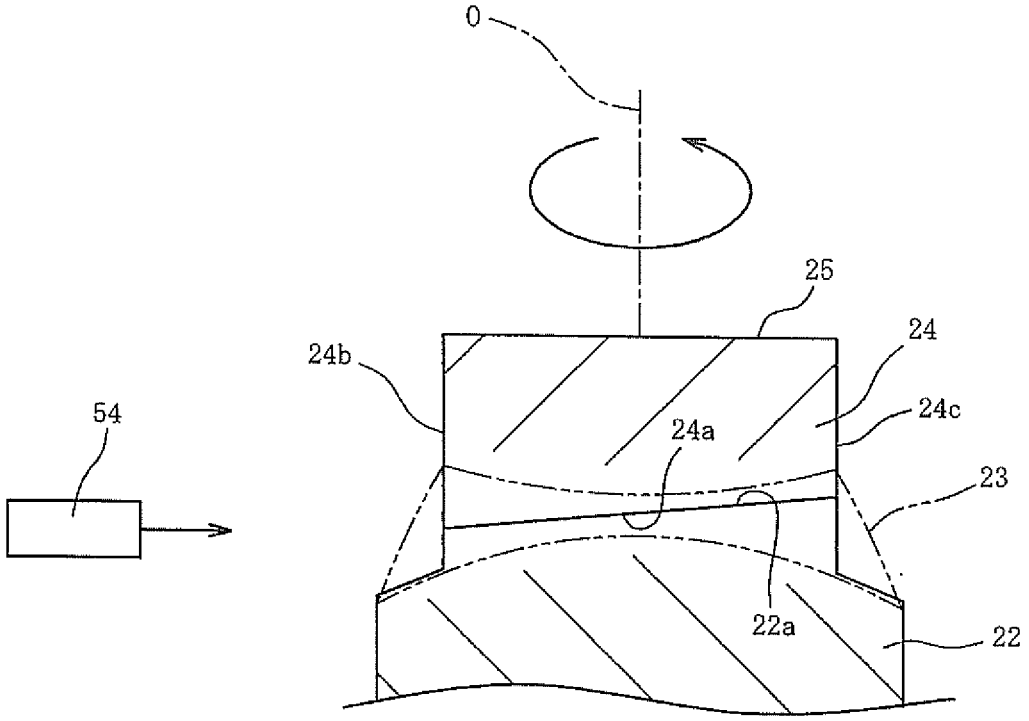
FIG. 5A is a schematic view when joining a tip to a base material.
Figure 5B:
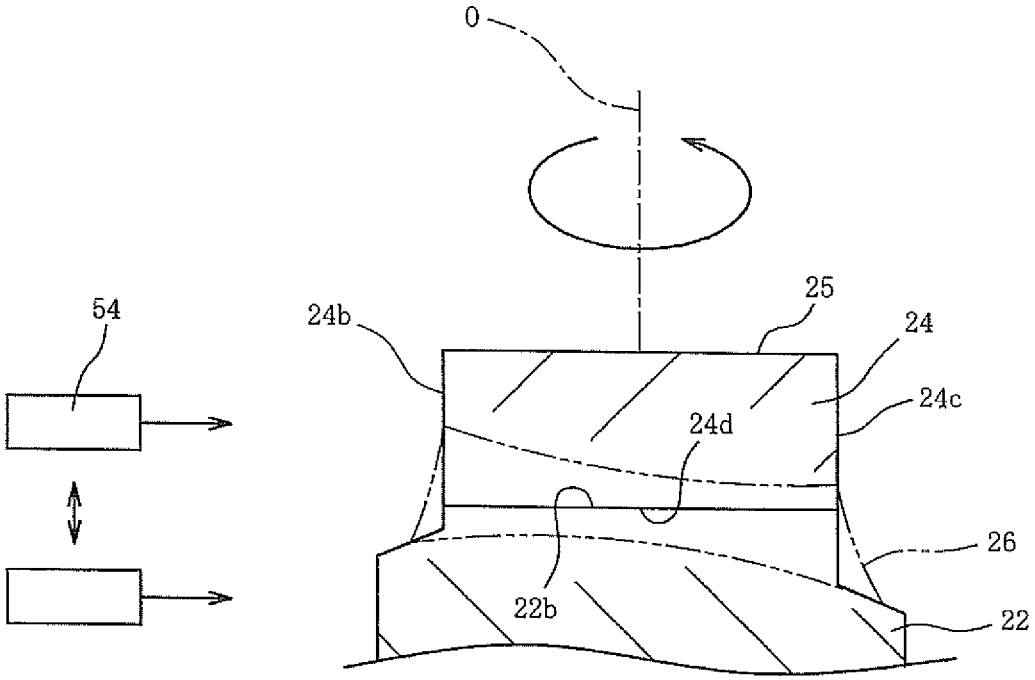
FIG. 5B is a schematic view when joining the tip to the base material according to a modified example.

An example of a method of producing the center electrode 20 will be explained with reference to FIG. 5A. FIG. 5A is a schematic view when joining the tip 24 to the base material 22, and shows a state before the fusion portion 23 (indicated by a two-dot chain line) is formed. FIG. 5B is similar to the above FIG. 5A.

A top end surface 22*a* of the base material 22 and an end surface 24*a*, located at an opposite side to the discharge surface 25, of the tip 24 are flat surfaces that obliquely cross the axis O. With these shapes, regarding both side portions 24*b* and 24*c* of the tip 24 which are located at opposite sides of the axis O, a length of the portion 24*b* between the discharge surface 25 and the end surface 24*a* of the tip 24 is longer than that of the portion 24*c*. In other words, a length of the portion 24*c* between the discharge surface 25 and the end surface 24*a* is shorter than that of the portion 24*b*. The tip 24 is placed on the base material 22 with its end surface 24*a* contacting the top end surface 22*a* of the base material 22 so that the discharge surface 25 of the tip 24 is orthogonal to the axis O.

After placing the tip 24 on the base material 22, by radiating high-energy beam such as laser beam and electron beam from a beam-machining head 54 provided so as to face to side surfaces of the base material 22 and the tip 24 while turning the base material 22 and the tip 24 on the axis O, the fusion portion 23 is formed, then the tip 24 is joined to the base material 22. Since the beam is radiated to the side surface of the base material 22, a melting amount at an outer side in a radial direction of the base material 22 is large as compared with that at a middle in the radial direction of the base material 22. Further, since the top end surface 22*a* of the base material 22 and the end surface 24*a* of the tip 24 slope, at the portion 24*b* of the tip 24 in the fusion portion 23, a melting amount of the tip 24 is larger than a melting amount of the base material 22, whereas at the portion 24*c* opposite to the portion 24*b* with respect to the axis O, a melting amount of the base material 22 is larger than a melting amount of the tip 24.

Returning to FIG. 4B, this will be explained in detail. In the present embodiment, at one end portion 64 of the overlap portion 62 in the second direction (the arrow Y direction) along the discharge surface 25 of the tip 24, since the melting amount of the tip 24 is larger than the melting amount of the base material 22, a noble metal content is greater than 50 mass %. On the other hand, at the other end portion 65 of the overlap portion 62 in the second direction, since the melting amount of the base material 22 is larger than the melting amount of the tip 24, a Ni content is greater than 50 mass %.

Therefore, at the one end portion 64, a thermal stress occurring at the second interface 61 is greater than a thermal stress occurring at the first interface 60. On the other hand, at the other end portion 65, a thermal stress occurring at the first interface 60 is greater than a thermal stress occurring at the second interface 61. Consequently, at the one end portion 64 side, a crack tends to appear at the second interface 61, whereas at the other end portion 65 side, a crack tends to appear at the first interface 60. Further, the crack appearing at the first interface 60 tends to develop along the first interface 60, and the crack appearing at the second interface 61 tends to develop along the second interface 61. However, even if the cracks develop in this way, thanks to the above structure, it is possible to reduce a tendency for the cracks developing along the first and second interfaces 60 and 61 to join together. Therefore, as compared with a case where cracks appearing at both ends of one interface develop toward the middle of the interface along the interface, coming-off of the tip 24 from the base material 22 due to rupture of the fusion portion 23 can be suppressed.

As mentioned above, in the fusion portion 23, since the melting amount at the outer side in the radial direction of the base material 22 is large as compared with that at the middle in the radial direction of the base material 22, the overlap portion 62 is shaped so that a distance between the first interface 60 and the second interface 61 along the first direction (the arrow Z direction) is gradually shorter from the outer side toward the middle. Thus, in the overlap portion 62, between the one end portion 64 and the other end portion 65, a shortest portion 66 at which the distance between the first interface 60 and the second interface 61 along the first direction is shortest exists at a portion except the one end portion 64 and the other end portion 65. Further, in the overlap portion 62, a middle portion 67 at which the noble metal content is 50 mass % and also the Ni content is 50 mass % exists at a portion except the shortest portion 66.

Therefore, as compared with a section of the first interface 60 from the one end portion 64 up to the middle portion 67, at a section of the first interface 60 from the other end portion 65 up to the middle portion 67, the crack appearing at the other end portion 65 side tends to develop along the first interface 60. On the other hand, as compared with a section of the second interface 61 from the other end portion 65 up to the middle portion 67, at a section of the second interface 61 from the one end portion 64 up to the middle portion 67, the crack appearing at the one end portion 64 side tends to develop along the second interface 61. Since the middle portion 67 is positioned at a different position from the shortest portion 66 in the second direction (the arrow Y direction), a position where the cracks developing along the first interface 60 and the second interface 61 respectively overlap each other in the first direction (the arrow Z direction) tends to be located at a portion except the shortest portion 66. Therefore, even if the cracks develop along the first direction at this position, since a distance between the first interface 60 and the second interface 61 at this position is longer than that at the shortest portion 66, rupture of the fusion portion 23 is suppressed, then the coming-off of the tip 24 from the base material 22 can be further suppressed.

A modified example of the center electrode 20 will be explained with reference to FIG. 5B. FIG. 5B is a schematic view when joining the tip 24 to the base material 22. Unlike the case of FIG. 5A, an end surface 24*d* of the tip 24 is parallel to the discharge surface 25, and a top end surface 22*b* of the base material 22 is a surface that is perpendicular to the axis O. After placing the tip 24 on the base material 22 with its end surface 24*d* contacting the top end surface 22*b* of the base material 22, by radiating high-energy beam from the beam-machining head 54 provided so as to face to side surfaces of the base material 22 and the tip 24 while turning the base material 22 and the tip 24 on the axis O and while moving the beam-machining head 54 backwards and forwards along the axis O, a path or a trail of the beam scanning surfaces of the base material 22 and the tip 24 becomes an oval shape.

Also in this case, a relationship, showing that in a sectional view of the center electrode 20 cut by a cutting-plane line passing through a center of gravity 63 of a projected planform of the overlap portion 62 onto a virtual surface parallel to the discharge surface 25 of the tip 24, the noble metal content is greater than 50 mass % (the melting amount of the tip 24 is larger than the melting amount of the base material 22) at the end portion of the overlap portion 62 on the portion 24*b* side and the Ni content is greater than 50 mass % (the melting amount of the base material 22 is larger than the melting amount of the tip 24) at the other end portion of the overlap portion 62 on the other portion 24*c* side, is established. Hence, the same mechanism and effect can be obtained.

Although the present invention is explained on the basis of the above embodiment, the present invention is not limited to the above embodiment. The present invention includes all design modifications and equivalents belonging to the technical scope of the present invention.

The above embodiment shows the example in which the groove is formed on the base material 41 of the ground electrode 40, and the tip 44, a part of which is accommodated in the groove, is joined to the base material 41. However, structures of the base material 41 and the tip 44 are not limited to this example. The base material 41 is not necessarily provided with the groove. And, the tip 44 could be joined to the base material 41 without forming the groove on the base material 41.

The above embodiment shows the example in which a top end surface of the tip 44 is positioned at a slightly inner side with respect to the top end surface 41*a* of the base material 41. However, the position of the tip 44 is not limited to this example. For instance, the tip 44 could be set so that its top end surface is positioned at an outer side with respect to the top end surface 41*a* of the base material 41, namely that the top end surface of the tip 44 protrudes from the top end surface 41*a* of the base material 41.

The above embodiment shows the example in which the tip 44 is joined to the inner surface 42 of the base material 41 of the ground electrode 40. However, the joining of the tip 44 is not limited to this example. The tip 44 could be joined to other portions such as the top end surface 41*a* of the base material 41, except the inner surface 42.

The above embodiment shows the example in which the tip 44 of the ground electrode 40 has the rectangular parallelepiped (a square column). However, a shape of the tip 44 is not limited to this example. As the shape of the tip 44, a cylindrical column and a polygonal column except the square column could be employed as necessary.

The above embodiment shows the example in which the tip 44 is directly joined to the base material 41 of the ground electrode 40 through the fusion portion 43. However, the joining of the tip 44 is not limited to this example. It could be possible to interpose an intermediate member principally made of Ni between the base material and the tip, and join the tip to the intermediate member joined to the base material through the fusion portion.

The above embodiment shows the example in which the relationship, showing that the noble metal content is greater than 50 mass % at the one end portions of the overlap portions 48 and 62 and the Ni content is greater than 50 mass % at the other end portions of the overlap portions 48 and 62, is established in both of the center electrode 20 and the ground electrode 40. However, the present invention is not limited to this example. As long as this relationship is established in either one of the center electrode 20 and the ground electrode 40, the present invention can be realized, and the tip of the electrode having this relationship can be prevented from coming off the base material.

In the above embodiment, as the example of the production of (the fusion portion 23 of) the center electrode 20, the tip 24 is set on the base material 22, and the high-energy beam is radiated while turning this set of the base material 22 and the tip 24 on the axis O. However, the production of (the fusion portion 23 of) the center electrode 20 is not limited to this example. For instance, the fusion portion 23 could be formed by setting the tip 24 on the base material 22 and performing the high-energy beam scan around the base material 22 and the tip 24 using one or more mirrors with this set of the base material 22 and the tip 24 remaining at rest.

EXPLANATION OF REFERENCE

10 . . . spark plug
20 . . . center electrode (first electrode, second electrode)
22, 41 . . . base material
23, 43 . . . fusion portion
24, 44 . . . tip
25, 45 . . . discharge surface
40 . . . ground electrode (first electrode, second electrode)
46, 60 . . . first interface (first boundary)
47, 61 . . . second interface (second boundary)
48, 62 . . . overlap portion
49, 63 . . . center of gravity
50, 51 . . . end portion (one end portion, the other end portion)
64 . . . one end portion
65 . . . the other end portion
52 . . . center position
53, 67 . . . middle portion
66 . . . shortest portion The entire contents of Japanese Patent Applications No. 2018-112958 filed on Jun. 13, 2018 is incorporated herein by reference.

Although the invention has been described above by reference to certain embodiment of the invention, the invention is not limited to the embodiment described above. Modifications and variations of the embodiment described above will occur to those skilled in the art in light of the above teachings. The scope of the invention is defined with reference to the following claims.

What is claimed is:

1. A spark plug comprising:

a first electrode, comprising:

a tip principally made of noble metal, the tip having a discharge surface;

a base material principally made of Ni; and a fusion portion through which the tip is joined to the base material, the fusion portion having an overlap portion where a first interface and a second interface overlap each other in a first direction that is perpendicular to the discharge surface of the tip, the overlap portion extending between first and second end portions of the overlap portion along a second direction that is parallel to the discharge surface, the first interface being between the tip and the fusion portion, the second interface being between the base material and the fusion portion; and a second electrode facing the discharge surface of the tip, wherein, when viewing a cross section of the first electrode where the cross section is perpendicular to the discharge surface and passes through a center of gravity of the overlap portion projected onto a virtual surface parallel to the discharge surface:

a noble metal content is greater than 50 mass % at the first end portion of the overlap portion; and a Ni content is greater than 50 mass % at the second end portion of the overlap portion.

2. The spark plug as claimed in claim 1, wherein the overlap portion has a center position that is centered between the first end portion and the second end portion in the second direction and extends along the first direction, wherein the overlap portion has a middle portion at which the noble metal content is 50 mass % and the Ni content is 50 mass %, the middle portion being positioned between the center position and the first end portion in the second direction, the middle portion extending along the first direction, and wherein a shape of the overlap portion on the cross section is such that a distance between the first interface and the second interface extending along the first direction gradually increases from the second end portion toward the first end portion in the second direction.

3. The spark plug as claimed in claim 1, wherein the overlap portion has a shortest portion that is positioned between the first end portion and the second end portion in the second direction and extends along the first direction, the shortest portion having a distance along the first direction that is less than a distance of any other portion of the overlap portion along the first direction, and wherein the overlap portion has a middle portion at which the noble metal content is 50 mass % and the Ni content is 50 mass %, the middle portion being positioned between the first end portion and the second end portion in the second direction, the middle portion extending along the first direction, the middle portion being at a position between the first end portion and the second end portion in the second direction that is different from a position of the shortest portion between the first end portion and the second end portion in the second direction.

4. The spark plug as claimed in claim 1, wherein a distance in the second direction between the first end portion and the second end portion of the overlap portion on the cross section is greater than a distance in the second direction between the first end portion and the second end portion at any other area of the overlap portion.

* * * * *